US008826715B2

(12) United States Patent
Abt et al.

(10) Patent No.: US 8,826,715 B2
(45) Date of Patent: Sep. 9, 2014

(54) FORMING DEVICE

(75) Inventors: Wilfried Abt, Rechberghausen (DE); Helmut Aichele, Goppingen (DE); Carsten Brechling, Ulm (DE)

(73) Assignee: Hinterkopf GmbH, Eislingen/Fils (DE)

( * ) Notice: Subject to any disclaimer, the term of this patent is extended or adjusted under 35 U.S.C. 154(b) by 848 days.

(21) Appl. No.: 13/034,243

(22) Filed: Feb. 24, 2011

(65) Prior Publication Data

US 2011/0214468 A1 Sep. 8, 2011

(30) Foreign Application Priority Data

Mar. 5, 2010 (EP) ..... 10002286

(51) Int. Cl.

| | |
|---|---|
| ***B21J 13/00*** | (2006.01) |
| ***B21D 51/26*** | (2006.01) |
| ***B30B 1/28*** | (2006.01) |
| ***B21D 22/02*** | (2006.01) |
| ***B30B 15/04*** | (2006.01) |
| ***B30B 1/26*** | (2006.01) |

(52) U.S. Cl.

CPC ..... *B21D 22/02* (2013.01); *B21D 51/2615* (2013.01); *B30B 1/28* (2013.01); *B30B 15/041* (2013.01); *B30B 1/266* (2013.01); *B30B 1/263* (2013.01)

USPC ..... 72/405.03; 72/94

(58) Field of Classification Search

USPC ..... 72/405.01, 405.03, 405.05, 405.07, 72/441, 442, 444, 446–450, 94; 29/37 R, 29/38 R

See application file for complete search history.

(56) References Cited

U.S. PATENT DOCUMENTS

| | | | | |
|---|---|---|---|---|
| 2003/0041643 | A1 | 3/2003 | Tang et al. | |
| 2008/0069665 | A1 * | 3/2008 | Hanafusa et al. | 413/1 |

FOREIGN PATENT DOCUMENTS

| | | |
|---|---|---|
| DE | 1777297 | 7/1971 |
| DE | 9200550 | 5/1993 |
| DE | 4307535 | 9/1994 |
| EP | 0275369 | 7/1988 |
| EP | 1518667 | 3/2005 |
| EP | 2123373 | 11/2009 |
| WO | WO0158618 | 8/2001 |
| WO | WO2004058597 | 7/2004 |

* cited by examiner

*Primary Examiner* — Debra Sullivan
(74) *Attorney, Agent, or Firm* — Hoffmann & Baron, LLP

(57) ABSTRACT

A forming device for cup-shaped hollow bodies (56) with a machine frame (2), a drive mechanism (6), a workpiece turntable (3) to support hollow bodies (56) and a tool carrier (4) to support machining tools (58), wherein the workpiece turntable (3) and tool carrier (4) oppose one another and can be rotated in relation to one another around an axis of rotation (5) and can be linearly displaced in relation to one another along the axis of rotation (5) and wherein the drive mechanism (6) is designed to provide a rotational stepping motion and a cyclical linear motion between the workpiece turntable (3) and the tool carrier (4), in order to allow the forming of the hollowing bodies (56) by means of the machining tools (58) in a plurality of sequential machining steps, as well as a stationary supporting tube (33) assigned to the machine frame (2), the central axis of which extends along the axis of rotation (5) and supports the tool carrier (4) and/or the workpiece turntable (3). On an external surface (36) of the supporting tube (33) a guiding device (40) is arranged, which is designed for the mounting with a linear motion of the tool carrier (4) and/or the workpiece turntable (3) on the supporting tube (33).

13 Claims, 2 Drawing Sheets

FORMING DEVICE

BACKGROUND OF THE INVENTION

The invention concerns a forming device for cup-shaped hollow bodies with a machine frame, a drive mechanism, a workpiece turntable to support hollow bodies and a tool carrier to support machining tools, wherein the workpiece turntable and tool carrier oppose one another and can be rotated in relation to one another around an axis of rotation and can be linearly displaced in relation to one another along the axis of rotation and wherein the drive mechanism is designed to provide a rotational stepping motion and a cyclical linear motion between the workpiece turntable and the tool carrier, in order to allow the forming of the hollow bodies by means of the machining tools in a plurality of sequential machining steps, as well as a stationary supporting tube assigned to the machine frame, the central axis of which extends along the axis of rotation and supports the tool carrier and/or the workpiece turntable.

From EP 0 275 369 A2 a forming machine is known, with which cup-shaped hollow bodies can formed from metal, in particular aluminium, from an essentially cylindrical sleeve-shaped initial state in some areas, in particular locally drawn, in order for example in the area of the opening to be able to position a cap or a spray valve providing a seal. The known forming machine has a machine frame on which a supporting tube is formed. On an external surface of the supporting tube a workpiece turntable is mounted in a rotating fashion. A recess delimited by the supporting tube incorporates a linearly displaceable guide tube, on the end area of which the tool carrier is positioned. The machine frame incorporates a drive mechanism, designed to generate a rotational motion of the workpiece turntable and to generate an intermittent oscillating linear motion of the guide tube and the tool carrier connected thereto. Through the linear motion the tools provided on the tool carrier, in particular forming tools, are brought into engagement with the hollow bodies retained on the workpiece turntable, in order to be able to machine these locally, in particular to plastically deform them. Through the intermittent rotating motion of the workpiece turntable the hollow bodies can be brought into contact in a serial sequence with the tools positioned on the tool carrier table, in order to achieve a stepwise forming of the hollow bodies into a target geometry from an initial geometry.

SUMMARY OF THE INVENTION

The problem for the invention is to provide a forming device having a simplified design which allows improved accuracy in the machining of the hollow bodies.

This problem is solved by a forming device of the kind mentioned initially with the features of claim 1. This provides for the arrangement of a guidance device on the external surface of the supporting tube, designed to support the tool carrier and/or the workpiece turntable in a linearly displaceable manner on the supporting tube. In this way, compared with the linear supporting of the tool carrier table of the prior art, which is provided for on the internal surface of the supporting tube, a greater supporting surface area is provided. This guarantees a more reliable supporting of the forces to be transferred during operation of the forming device from the tool carrier and/or the workpiece turntable to the supporting tube. In addition, the linear guidance for the tool carrier and/or the workpiece turntable can be designed in such as way that along the entire length of the tool carrier and/or the workpiece turntable in relation to the supporting tube the same support conditions constantly apply. As a result of this the machining tolerances for the hollow body machining can be kept within a tight range. During the machining of the hollow bodies the workpiece turntable and/or the tool carrier move along the at least one linear guidance arranged externally on the supporting tube, relative to the supporting tube.

Advantageous further developments of the invention are the subject matter of subclaims.

It is useful if the supporting tube is arranged in a stationary manner on the machine frame. In this way a highly resilient force transmission between the supporting tube and the machine frame is guaranteed, independently of the operational state or operational position of the forming device, whereby an advantageous supporting of the tool carrier and/or the workpiece turntable is ensured.

It is advantageous if the machine frame comprises a rotary bearing for the workpiece turntable or the tool carrier arranged with a spacing from the supporting tube. As a result of the spacing and the resultant at least partial mechanical decoupling thereby caused of the rotary bearing from the linear bearing formed by the supporting tube, the forces and moments to be transferred from the supporting tube to the machine frame, in particular bending moments, and associated elastic deformations of the supporting tube do not or only to a minor extent lead to undesired deflections and/or stressing of the rotary bearing. This guarantees an advantageous mechanical decoupling of the rotary bearing from the linear guidance, meaning that the machining accuracy for the hollow bodies can be improved. Preferably the rotary bearing is displaced in the radial direction outwards from the supporting tube. Particular preferably a longitudinal axis of the supporting tube and the axis of rotation determined by the rotary bearing are arranged concentrically to one another.

In one design of the invention it is envisaged that the rotary bearing and the supporting tube are arranged jointly on a support plate of the machine frame. The support plate serves for the transfer of forces between the supporting tube and the tool carrier or the workpiece round table arranged thereon with a linear motion and the workpiece round table or tool carrier arranged by means of the rotary bearing on the support plate. The support plate is preferably designed so that under the machining forces generated during the operation of the forming device it is not or is only slightly elastically deformed. In this way the desired, at least almost complete, mechanical decoupling of the supporting tube on the one hand and the rotary bearing on the other is guaranteed. In a preferred embodiment of the invention the supporting tube, in particular with a circular cross-section design, and the rotary bearing are arranged on the support plate displaced with reference to the axis of rotation in the radial direction, in particular concentrically to one another. Here the rotary bearing encompasses the supporting tube, as a result of which it is possible to select the diameter of the rotary bearing to be considerably larger than the diameter of the supporting tube. The diameter of the rotary bearing is preferably selected to be at least approximately as large as the diameter of the, preferably circular designed tool carrier or workpiece turntable. In this way an advantageous supporting of the forces acting parallel to the axis of rotation on the tool carrier or the workpiece turntable by the support plate and the rotary bearing arranged between the tool carrier or the workpiece turntable and the support plate can be guaranteed.

It is preferably envisaged that the support plate together with a support frame form a first machine frame section and that the drive mechanism is supported by supporting brackets, forming a second machine frame section, so that an at least extensive decoupling between the forces provided by the drive mechanism and the workpiece turntable and the tool carrier is achieved. The two sections of the machine frame divert the forces impinging on them in each case preferably onto a base plate. The base plate can take the form of a further part of the machine frame and/or part of a foundation structure for the forming device and closes off the flow of forces between the two machine frame sections. This base plate can have a particularly stable design, so that it is not or only slightly deformed by the forces arising during operation of the forming device. The base plate is preferably designed in such a way that it allows an at least extensive, in particular almost total, mechanical decoupling of the two machine frame sections from one another. In this way, the forces and vibrations emanating for example from the drive mechanism which are introduced into the second machine frame section, can at least extensively be kept away from the first machine frame section and thus no disturbing influence can be exerted on the tool carrier and the workpiece turntable which are arranged on the first machine frame section with relative movement to one another.

In an advantageous further development of the invention it is envisaged that between the first machine frame section and the second machine frame section an articulated, preferably flexible coupling area in particular in the form of a solid state joint is provided. The coupling area serves on the one hand to close off the flow of forces between the first and second machine frame sections and on the other the coupling area is intended to provide the most extensive possible decoupling of the two machine frame sections. The coupling area is preferably designed as a flexible articulated element, in particular as a solid state joint. This ensures that the two machine frame sections are connected together without play. The solid state joint is preferably incorporated into the first machine frame section, for example in the area of a joint between the support plate and the base plate.

It is useful if an articulation axis of the articulated coupling area is aligned transversally to the axis of rotation. Depending on the design of the coupling area, the articulation axis can be an actual physical axis or, in particular a solid state joint, around a geometrical axis. As a result of the alignment according to the invention of the articulation axis the coupling area serves to decouple the linear vibrations generated by the drive mechanism and impinging in particular along the axis of rotation from the support plate. In order to decouple the linear vibrations of the drive mechanism, the support plate preferably performs a tilting motion relative to the drive mechanism around the articulation axis. This prevents the linear vibrations emanating from the drive mechanism from penetrating as far as the tool carrier and/or workpiece turntable and influencing the machining quality there.

In a further development of the invention it is envisaged that between the supporting tube and the tool carrier or the workpiece turntable, a preferably pre-tensioned, in particular play-free pre-tensioned, rolling bearing arrangement is formed. A rolling bearing arrangement allows high relative speeds for the oscillating linear motion between the tool carrier or workpiece turntable and the supporting tube. Since with this linear motion the tool carrier or the workpiece turntable always moves along the same section of the supporting tube, the use of a rolling bearing arrangement is advantageous since due to the rolling friction of the rollers this results in less generation of heat than a corresponding sliding bearing. In particular the roller body arrangement is preferably pre-tensioned, in order to guarantee a low-play, preferably play-free bearing of the tool carrier or workpiece turntable on the supporting tube. The pre-stressing of the roller body arrangement is preferably designed so that a rotational movement of the tool carrier or the workpiece turntable around the axis of rotation and around a tilting axis aligned transversally to the axis of rotation is at least in part avoided, preferably completely.

It is advantageous if on an internal surface of the supporting tube preferably a bearing device for a coupling slide of the drive mechanism is formed as a sliding bearing, providing a force-transmitting joint between a connecting rod of the drive mechanism and the tool carrier or the workpiece turntable. The coupling slide is provided, in order to convert the oscillating motion provided by the drive mechanism preferably in the form of a crank motion, as a super-positioning of a linear motion with a slewing motion, to a purely linear motion, which can then be passed on to the tool carrier or workpiece turntable. To this end the coupling slide is connected with the connecting rod arranged on the crank mechanism of the drive mechanism and supported in the supporting tube in a linearly moveable manner. Since according to the invention the bearing of the tool carrier or the workpiece turntable is envisaged on the external surface of the supporting tube, the internal surface of the supporting tube can be used to support the coupling slide. In this way, apart from an advantageous guidance of the coupling slide a compact design for the forming device is also achieved. Particularly preferably the coupling slide rests on the internal surface of the supporting tube in always the same way along the entire length of the linear oscillating motion.

In a further design of the invention between the coupling slide and the tool carrier or workpiece turntable a preferably circular design, flexible coupling means is arranged which is designed for the transfer of force between coupling slide and tool carrier or workpiece turntable and for decoupling tilting motions of the coupling slide transversally to the axis of rotation. The flexible coupling means during the machining process for the hollow bodies for the execution of the linear oscillating motion is initially impinged upon by a force of pressure in order to move the tool carrier or the workpiece turntable towards the workpiece turntable or tool carrier opposite and to bring the machining tools into engagement with the hollow bodies. In a subsequent phase of the linear oscillating motion tensile forces are introduced into the coupling means in order to increase the distance between the tool carrier and the workpiece turntable again and thus to distance the machining tool from the hollow body. The flexible coupling means is preferably designed in the form of a sleeve, in particular in a thin-walled metal material. Particularly preferably the flexible coupling means is aligned concentrically with the axis of rotation of the tool carrier or workpiece turntable.

In a further development of the invention it is envisaged that a guide length for the tool carrier or the workpiece turntable along the supporting tube and/or for the coupling slide along the supporting tube is at least 1.5 times, preferably at least 2 times, in particular at least 2.5 times the maximum travel of the tool carrier or workpiece turntable. The guide length is the maximum distance between the respective external rollers of the linear guides along the axis of rotation, allocated to the tool carrier or workpiece turntable. By supporting the tool carrier or workpiece turntable over such a guide length at the maximum travel of the drive mechanism it is ensured that the tool carrier or the workpiece turntable is always reliably guided on the supporting tube.

It is useful if the supporting tube and the tool carrier or the workpiece turntable, are arranged in a self-supporting manner on the support plate. In this way an advantageous accessibility of the tool carrier or workpiece turntable is guaranteed, for example to allow a quick-change of the tool carrier or workpiece turntable.

BRIEF DESCRIPTION OF THE DRAWINGS

An advantageous embodiment of the invention is shown in the drawing, wherein.

DETAILED DESCRIPTION OF THE PREFERRED EMBODIMENTS

Figure 1:
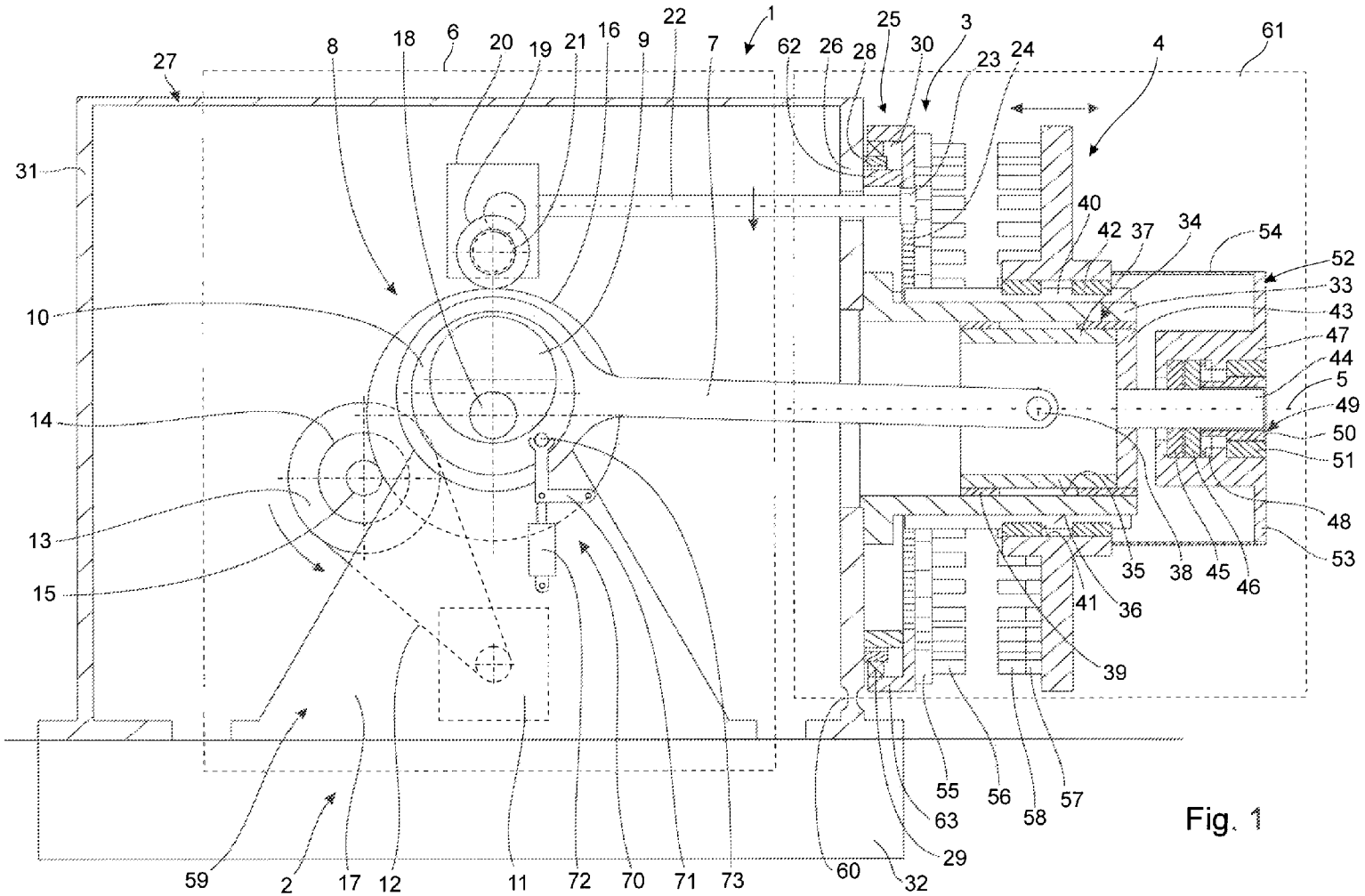
FIG. 1 shows a two-dimensional, schematic sectional representation through a forming device.

A forming device 1 shown in FIG. 1, which can be used in particular for forming cup-shaped hollow bodies, comprises a machine frame 2, on which a workpiece turntable 3 and a tool carrier 4 are arranged. In the embodiment shown of the forming device 1 the workpiece turntable 3 is positioned on the machine frame 2 so that it can rotate, while the tool carrier 4 is by way of example arranged linearly on the machine frame 2. The workpiece turntable 3 is thus supported in relation to the machine frame 2 and the tool carrier in a rotating manner around an axis of rotation 5. The tool carrier 4 can be displaced linearly along the axis of rotation 5 in relation to the machine frame 2 and the workpiece turntable 3. The forming device 1 also comprises a drive mechanism 6, which is designed to provide an intermittent rotating motion or rotational stepping motion and to provide a cyclical oscillating linear motion. In this case the drive mechanism 6 is designed to provide the rotational stepping motion at the workpiece turntable 3 and to provide the cyclical oscillating linear motion at the tool carrier 4.

The drive mechanism 6 comprises inter alia a double eccentric arrangement 8. The double eccentric arrangement 8, which comprises an internal eccentric 9 also referred to as an eccentric shaft and an external eccentric 10 also referred to as an eccentric bush, serves as an adjustable crank mechanism with respect to the crank travel in order to provide a circular orbital motion for a connecting rod eye that is not described in more detail of a connecting rod 7.

The forces necessary to drive the connecting rod 7 are provided by way of example by a drive motor 11 in the form of an electric motor, which is coupled by means of a belt drive 12, for example with a V-ribbed belt design, with a flywheel 13. The flywheel 13 can be brought into force-transferring contact with a driving pinion 15 via a flywheel coupling 14 that can be coupled during operation of the forming device 1. The driving pinion 15 engages with the main gear 16, which is supported in a rotating manner on two supporting brackets 17, only one of which is visible in FIG. 1 as a result of this being a cross-sectional representation. On the main gear 16 in a mirror-image arrangement two, preferably in each case integrally formed, by way of example cylindrically designed bearing pins 18 are positioned, which are arranged concentrically with the main gear 16 and which in a manner that is not shown respectively protrude into a support corresponding to one of the supporting brackets 17 and serve for rotational support of the main gear 16. In addition, on the main gear 16 the internal eccentric 9 is arranged in a stationary manner, while the external eccentric 10 is supported in a displaceable manner on the main gear 16, in order to be able to set the crank travel of the double eccentric arrangement 8 for the connecting rod 7.

To set the maximum travel the external eccentric 10 can be decoupled by means of a coupling, not shown in more detail, from the eccentric 9 and for setting the travel rotated by means of a drive mechanism likewise not shown in more detail preferably steplessly around an axis of rotation running normally the presentation plane, relative to the internal eccentric 9. Then the coupling is closed again so that the two eccentrics 9 and 10 are again coupled together for force transmission purposes.

The main gear 16 is also in permanent engagement with a driving gear 19, which can be brought into force transmitting contact with a step-by-step motion gear 20 by means of a step-by-step motion gear coupling 21 switchable during operation of the forming device 1. The step-by-step motion gear 20 converts the continuous rotational motion of the driving gear 19 into a discontinuous, intermittent rotating step motion, which is transmitted by means of a step-by-step selector shaft 22 and a step-by-step selector pinion 23 to the workpiece turntable 3. By way of example on the workpiece turntable 3 an internal arrangement of teeth 24 is formed, with which the step-by-step selector pin engages, in order to transmit the stepped rotational motion of the step-by-step motion gear 20 to the workpiece turntable 3, which then executes the stepped rotational motion around the axis of rotation 5. Alternatively, in place of the step-by-step motion gear 20 a servo drive can be used which allows an electrically controlled stepped rotational motion.

As an example, the workpiece turntable 3 is supported by a means of a rotary bearing 25 on a support plate 26. The support plate 26 is part of a first machine frame section, which also comprises a support frame 31. The support frame 31 has the specific task of diverting the torques which through the weights of the subassemblies arranged on the support plate 26, to be described in more detail in the following, impinge on the support plate, into a base plate 32.

The rotary bearing 25 for example comprises a preferably circular bearing ring 28 arranged on the support plate 26, which on a rotating external surface has a bearing surface for a plurality of schematically shown rollers 29. The rollers 29 are arranged between the bearing ring 28 and a bearing surface 30 opposite the bearing ring 28, arranged on the workpiece turntable 3 by way of example in the form of an encircling collar 63 and are held in position by a cage that is not shown in more detail. Together with bearing ring 28 and the encircling collar 63 they form a radial bearing, which guarantees a low-friction and in particular in relation to the axis of rotation 5 and the tool carrier 4 a highly accurate rotational motion of the workpiece turntable 3. Supporting of the machining forces which impinge in the direction of the axis of rotation 5 on the workpiece turntable 3, takes place for example by means of a circular sliding bearing ring 62, which rests flat on the surface of the workpiece turntable 3. The sliding bearing ring 62 and the surface of the workpiece turntable 3 arranged opposite are preferably supplied by a lubrication circuit which is not shown in more detail with an intermittent or continuous supply of lubricant.

On a surface of the support plate 26 opposing the drive mechanism 6 and displaced from the rotary bearing 25 a supporting tube 33 is positioned, which by way of example serves for the support and linear bearing of the tool carrier 4. The supporting tube 33 in a cross-sectional plane which is not shown aligned normally with the axis of rotation 5 has a by way of example circular section. A cylindrical internal surface 35 of the supporting tube 33 serves as a sliding bearing surface for a coupling slide 34, which is coupled with the connecting rod 7 and which serves to convert the combined rotational and linear motion of the connecting rod 7 into a linear motion.

The coupling slide 34 comprises by way of example a base body 37 with a tubular design, to which a bearing bolt 38 is applied for the bearing of the connecting rod 7 with a rotating motion. On the base body 37 a plurality of external radial, preferably circular, sliding blocks 39 by way of example made from plain bearing bronze, are arranged which are designed for the sliding motion on the internal surface 35 of the supporting tube 33 made, by way of example, from metal.

On an external surface 36 of the supporting tube 33 a plurality of support rails 40 extending parallel to axis of rotation 5 are arranged, which serve as linear guide elements for the tool carrier 4. The support rails 40 are preferably arranged at the same angular pitch around the axis of rotation 5, for example at a 120 degree pitch or a 90 degree pitch.

For the linear guidance of the tool carrier 4 in addition on the radial internal surface 41 of the tool carrier 4 corresponding to the support rails 40 linear guides 42 also referred to a ball castor shoes are arranged, which encompass the support rails 40 in each case by their U-shape. The linear guides 42 can for example be designed as rolling element and guideway assemblies in which a number of cylindrical or spherical rolling elements are incorporated in a guideway and allow a linear relative motion in relation to the respective support rail 40. The linear guides 42 are preferably clamped against each other by means of clamping means not shown in more detail in the radial direction and/or in the circumferential direction of the supporting tube 33, whereby a low-play, in particular play-free, linear supporting of the tool carrier 4 in relation to the supporting tube 33 is achieved. Thanks to the linear guides 42 the tool carrier 4 is held secure against the supporting tube free from rotation.

On the base body 37 of the coupling slide 34 on the end face turned away from the connecting rod 7 a closing plate 43 is arranged, carrying a threaded spindle 44. The threaded spindle 44 extends by way of example parallel, in particular concentrically, to the axis of rotation 5. Two spindle nuts 45, 46 arranged at a distance from one another along the axis of rotation engage with the external thread not shown in more detail of the threaded spindle 44. The two spindle nuts 45, 46 are joined with each other in a rotationally secure and a linearly displaceable manner. The second spindle nut 46 is a preferably hydraulically controllable, linear adjusting device 48 with a servomotor 49 assigned to it.

The job of the servomotor 49, which is preferably designed as a torque motor and comprises a rotor 50 mounted so that is can rotate coupled with the second spindle nut 46 and a stator 51, which is securely seated in a carrier 52, consists of displacing the two spindle nuts 45, 46 through rotation along the threaded spindle 44 and thereby to allow adjustment of a starting position of the tool carrier 4 along the threaded spindle 44.

The job of the linear adjustment device 48, which can exert a force in the direction of the axis of rotations on the second spindle nut 46, is to secure the second spindle nut 46 in relation to the first spindle nut 45 and in this way to allow a play-free transmission of force between threaded spindle 44 and carrier 52 in which the spindle nuts 45 and 46 are included in a stationary and rotationally moveable manner.

By way of example the carrier 52 is designed as an essentially rotationally symmetrical body and has a circumferential flange 53, to which tubular coupling means 54 are secured designed for a force transmitting connection with the tool carrier 4. The flange 53 and the coupling means 54 are dimensioned so that as a result of the forces transmitted from the tool carrier 4 to the workpiece turntable 3 they are slightly elastically deformed and in the process any tilting movements of the coupling slide 34 and of the carrier 47 around tilting axes transversal to the axis of rotation 5 are at least in part absorbed, so that these are not or in any case only partly transmitted to the tool carrier 4. In combination with the at least essentially play-free supporting of the tool carrier 4 on the supporting tube 33 a particularly high accuracy for the machining of the hollow body 55 positioned on the workpiece turntable 3 is achieved.

In the following a number of aspects of the functioning of the forming device 1 are outlined. Here it is assumed that on the workpiece turntable 3 a number of workpiece holders 55 also referred to as chucks are positioned, arranged at an equal angular pitch to the axis of rotation 5, in which cup-shaped hollow bodies 56 are held. On the surface of the tool carrier 4 opposite the workpiece turntable 3 corresponding to the workpiece holders 55 corresponding toolholders 57 are arranged, which are loaded with machining tools 58, for example with forming tools.

In order to put into operation the forming device 1 shown in FIG. 1 initially the couplings, in particular the flywheel coupling 14 and the step-by-step motion gear coupling 21, are brought into a coupled, force transmitting position. In addition, prior to the putting into operation, the eccentric or crank travel for the connecting rod 7 and the coupling slides 34 thereby coupled, can be set through the relative motion and arresting of the external eccentric 10 in relation to the internal eccentric 9. Furthermore, the starting position of the tool carrier 4 along the axis of rotation 5 can be set by operation of the servomotor 49 and the spindle nuts 45, 46 coupled therewith. Then the spindle nuts 45, 46 are arrested by means of the linear adjusting device on the threaded spindle 44.

In order to put into operation the forming device 1 the drive motor 11 is has voltage applied and generates a rotational motion, which via the belt drive 12 is passed on to the flywheel 13. The driving pinion 15 which is connected in a force-transmitting manner with the flywheel 13 sets the main gear 16 in motion. In this way on the one hand by means of the double eccentric arrangement 8 a crank motion is introduced to the connecting rod 7. In addition by means of the driving gear 19 the step-by-step motion gear 20 is set in motion. With the couplings 14, 21 closed there is a kinematically enforced coupling between the motion of the connecting rod 7 and thus of the tool carrier 4 and the motion of the step-by-step motion gear 20 and thus the workpiece turntable 3.

By means of the crank motion of the double eccentric arrangement 8 and the coupling via the connecting rod 7 the coupling slide 34 is set in an oscillating linear motion, which is transferred via the threaded spindle 44, the spindle nuts 45, 46, the carrier 47 and the coupling means 54 to the tool carrier 4, which executes this linear motion in the same way as the coupling slide 34.

The workpiece turntable 3 through the step-by-step motion gear 20 and the thereby connected selector shaft 22 and the step-by-step selector pinion 23 and the internal arrangement of teeth 24 of is set in a rotational stepping motion around the axis of rotation 5. Here the rotational stepping motion of the workpiece turntable 3 and the oscillating linear motion of the tool carrier 4 are matched to one another such that the workpiece turntable 3 is at rest for the interval of time in which the machining tools 58 arranged on the tool carrier 4 are in engagement with the hollow bodies 56. The workpiece turntable 3 executes the rotational stepping motion if the machining tools 58 are not engaged with the hollow bodies 56. In this way the machining tools 58 in the course of the combined linear and rotational stepping motion of the tool carrier 4 and the workpiece turntable 3 can be brought into engagement with the hollow bodies 56 in order to achieve a stepwise forming of the hollow bodies 56.

As a result of the crank motion of the double eccentric arrangement 8 and the connecting rod 7 coupled thereto during the operation of the forming device 1 considerable forces of inertia and vibrations occur. In order to keep these disturbances at least to the greatest possible extent away from the hollow bodies 56 and the machining tools 58, the supporting brackets 17, which essentially form the second machine frame section 59, are designed to be dimensionally stable and are anchored securely to the base plate 32, which for its part is very heavy and thus cannot be, or only to a very small extent, set in motion by the disturbances. The support plate 26, which carries both the supporting tube 33 for guiding the tool carrier 4 and the bearing ring 28 for rotary bearing of the workpiece turntable, is likewise designed to be dimensionally stable and is not, or only to a very small extent, deformed by the forces arising during operation of the forming device 1.

In order on the one hand to achieve the most extensive decoupling of the support plate 26 from the drive mechanism 6 and on the other a reliable flow of forces between support plate 26 and drive mechanism 6, the support plate 26 is connected by means of a coupling area 60 in an articulated fashion with the base plate 32. Since in addition the support frame 31 has a markedly higher elasticity than the support plate 26, a machining unit 61 comprising support plate 26, workpiece turntable 3, tool carrier 4 and supporting tube 33 can be seen as an in itself rigid and as a result with regard to the machining process accurate subassembly. The machining unit 61 is flexibly connected via the coupling area 60 and the support frame 31 with the base plate 32. The motion provided by the connecting rod 7 is introduced into the machining unit 61 by means of the coupling slide 34 incorporated with a sliding motion in the supporting tube 33. The coupling means 54 arranged between the coupling slide 34 and tool carrier 4 decouples any tilting motions of the coupling slide 34, so that the tool carrier 4 is impinged by a purely linear motion. Since the tool carrier 4 is also accommodated on the support rails 42 by means of the pre-tensioned, in particular play-free linear guides 42, precise positioning of the machining tools 58 in relation to the hollow bodies 56 is guaranteed.

In order to perform the relative rotation of the internal eccentric 9 in relation to the external eccentric 10 and the in particular stepless adjustment of the working travel to be brought about thereby, a locking device 70 is provided comprising a pivoting locking lever 71 mounted on the machine frame 2, adjusting means 72 for example in the form of a hydraulically actuated cylinder and an adjusting bolt 73 protruding in the axial direction on the external eccentric 10.

With the help of the locking device 70 the external eccentric 10 can be secured, in that the adjusting means 72 is actuated by the control mechanism which is not shown and the locking lever pivots in such a way that it can come into engagement with the adjusting bolt 73. Then the drive motor 11 is operated by the control unit in such a way that the main gear 16 performs a slow, in the representation of FIG. 1 preferably in the clockwise direction rotational motion. During this rotational motion initially both the internal eccentric 9 and the external eccentric 10 move as well, until the adjusting bolt 73 comes into engagement with the fork-shaped locking lever 71. From this point in time onwards a further rotation of the external eccentric 10 is prevented by the swung-in locking lever 71, while the internal eccentric in the event of further rotation of the main gear 16 can rotate relative to the external eccentric 10.

By means of this relative rotation between the internal eccentric 9 and the external eccentric 10 the desired setting of the working travel is brought about. As a result of the reduction in the rotational movement between the drive motor 11 and the main gear 16 a very fine angular resolution for the relative movement between the internal eccentric 9 and the external eccentric 10 can be achieved, so that a practically stepless setting of the working travel is made possible.

As soon as the desired working travel between the internal eccentric 9 and the external eccentric 10 has been set, by means of a reversing motion of the drive motor 16 the adjusting bolt 73 is disengaged from the locking lever 71. Then the locking lever 71 with the help of the adjusting means 72 is brought into a neutral position which is not shown and the forming device 1 can now be brought into operation with the newly set working travel.

When setting the working travel there may be a change in the phasing between the cyclical linear motion and the rotational stepping motion. This is attributable to the fact that the top and bottom dead centres of the double eccentric arrangement 8 which result from the position of the two eccentrics 9, 10 in relation to each other, during adjustment shift relative to the connecting rod 7. Without compensation for the shift in phasing a pre-determinable timing of the cyclical linear motion and the rotational stepping motion would no longer be guaranteed once the travel has been set. By setting the phasing the abovementioned timing can be specified and matched exactly to the needs of the machining process for the hollow bodies.

Figure 2:
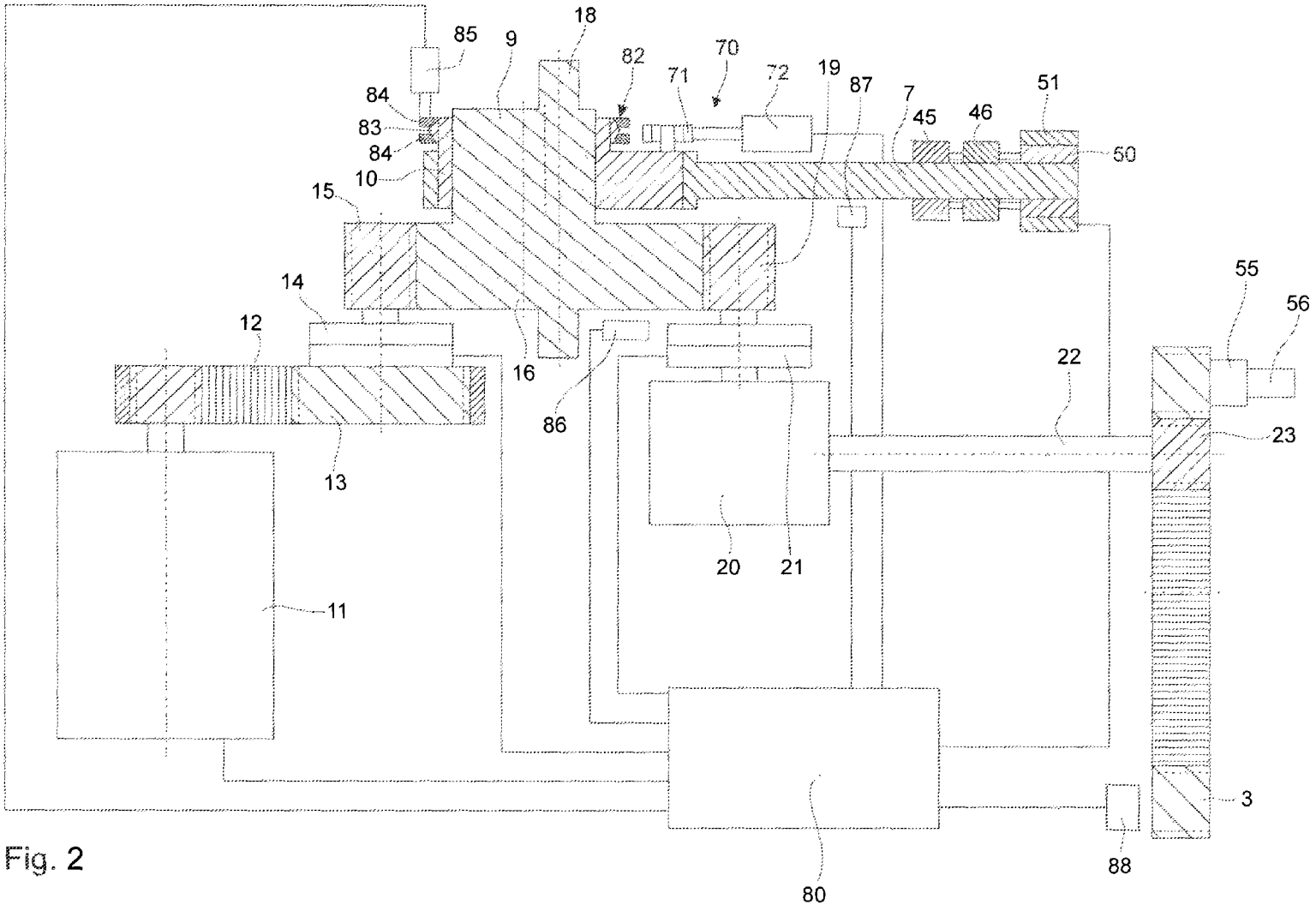
FIG. 2 shows a schematic representation of the drive mechanism with the first and second drive means.

The preferably stepless adjustment to be carried out of the phasing between the rotational stepping motion and the cyclical linear motion is explained in the following using the schematic representation of FIG. 2. In FIG. 2, for reasons of clarity only the components of the forming device 1 according to FIG. 1 that are essential for the adjusting processes are shown. Some of the components shown in FIG. 2 are for their part, for reasons of clarity, not shown in FIG. 1, but nevertheless constitute integral parts of the forming device 1 according to FIG. 1. The drive motor 11 is connected via the belt drive 12 with the flywheel 13 and when duly operated by the control device 80 can initiate a rotating motion at the flywheel 13. The flywheel 13 has the flywheel coupling 14 assigned to it, which by means of an internal adjusting means that is not shown in more detail can be switched between a decoupled and a force-transmitting position. The adjusting means in the flywheel coupling 14 is connected with the control device 80 in order to receive a corresponding switching signal.

On the drive side clutch plate that is not described in more detail of the flywheel coupling 14 the driving pinion 15 is positioned secured against rotation which meshes with the main gear and thus allows an introduction of the rotational motion of the flywheel 13 to the main gear 16, provided that the flywheel coupling is coupled. The first eccentric 9 is integrally formed on the main gear 16, and furthermore similarly integrally formed bearing pins 18 are arranged on the main gear 16 which are intended for the rotational bearing of the main gear 16 on the supporting brackets 17 not shown in FIG. 2.

The drive gear 19 meshes with the main gear 16 thereby allowing the transmission of the rotational motion to the step-by-step motion gear coupling 21. In the step-by-step motion gear coupling 21 an adjusting means that is not shown in more detail is incorporated, which is able to switch the step-by-step motion gear coupling 21 between a decoupled and a force-transmitting position. This adjusting means is likewise connected with the control device 80 in order to receive a corresponding switching signal.

With a coupled and thus force-transmitting step-by-step motion gear coupling 21 the rotational motion of the driving gear 19 can be transferred to the step-by-step motion gear 20, which from the continuous rotational motion of the main gear 16 generates a rotational stepping motion with a pre-determinable angular increment. This rotational stepping motion is transmitted via the step-by-step selector shaft 22 and the step-by-step selector pinion 23 to the workpiece turntable 3.

The external eccentric 10 is positioned in a rotatable manner on the internal eccentric 9. In order to secure the external eccentric 10 on the internal eccentric 9 against rotation, the external eccentric 10 has a thin-walled sleeve section 81, on which a clamping set 82 designed as a switchable coupling is arranged. The clamping set 82 comprises a double cone ring 83 resting on the periphery of the sleeve section 81 and two clamping rings 84 resting on the respective conical external surfaces of the double cone ring, which on an internal circumference are in each case conically designed.

The clamping set 82 is assigned a clamping means 85 which is set up in order to introduce the axial forces onto the two clamping rings 84 in order to bring these closer together or move them further apart in the axial direction and thus to allow the introduction of radial clamping forces to the double cone ring 83 and thus to the sleeve section 81 of the external eccentric 10. Thus the external eccentric 10 can optionally be mounted secured against rotation or in a rotating manner on the internal eccentric 9, according to a control signal from the control device 80 which impinges on the clamping means 85.

As has already been stated regarding FIG. 1, the external eccentric 10 can be secured by means of the locking device 70, in order then to perform the adjustment of the internal eccentric 9 relative to the external eccentric 10 and thus the setting of the working travel for the connecting rod 7. In order to detect the relative rotation of the two eccentrics 9, 10 the main gear 16 and the internal eccentric 9 which is thus connected with it secured against rotation, have a rotational angle sensor 86 assigned the sensor signal of which is transmitted to the control device 80.

The relative rotation of the two eccentrics 9, 10 can preferably then be determined if the external eccentric 10 is secured by means of the locking device 70, since in this way its rotational position is also known. The rotational position of the internal eccentric 9 is determined by the rotational angle sensor 86. As soon as the desired relative rotation between the internal eccentric 9 and the external eccentric 10 has been reached, the external eccentric 10 can be secured by actuating the clamping means 85 against rotation on the internal eccentric 9.

When adjusting the working travel by means of the relative rotation of the two eccentrics 9, 10 the position of the top and bottom dead centres of the double eccentric arrangement 8 in relation to the connecting rod 7 can change. Thus this is accompanied by a change in the phasing of the cyclical linear motion with respect to the step-by-step motion gear 20. Depending on the machining process, however, this is not desirable for the hollow bodies 56. Therefore the phasing between the rotational stepping motion and the cyclical linear motion can be corrected once the adjustment of the working travel has been carried out.

For the, preferably stepless, correction of the phasing initially the external eccentric 10 is secured against rotation on the internal eccentric 9 by means of the clamping set 82. The flywheel coupling 14 is closed, the step-by-step motion gear 20 on the other hand is open. The locking device 70 is in the neutral position so that the rotational movement of the external eccentric 10 is not inhibited. In the presence of these conditions the control device 80 can actuate the drive motor 11, and bring the connecting rod 7 through rotation of the main gear 16 into the desired position. This can take place on the basis of a reduction in the rotational movement between the drive motor 11 and the main gear 16 and with a suitable design of the control device 80 with an angular resolution allowing a practically stepless setting of the phasing between the cyclical linear motion and the rotational stepping motion. For the correct setting of the phasing the control device 80 stores a table of values or an algorithm with which or with the help of which as a result of the previously performed setting of the working travel the phase displacement of the cyclical linear motion in relation to the rotational stepping motion can be determined. The phasing can also be checked by querying the rotational position of the workpiece turntable 3 by means of the workpiece turntable sensor 88, which for example takes the form of an incremental rotation angle sensor or an inductive proximity sensor.

In order to monitor the position of the connecting rod 7 a linear sensor 87 may also be provided, the signals of which is provided to the control device 80 and can be compared there with the signals from the rotation angle sensor 86.

As soon as the double eccentric arrangement 8 and the connecting rod 7 coupled therewith have reached the position in which the desired phasing between the first drive means, which essentially is formed by the step-by-step motion gear 20, and the second drive means, which essentially is formed by the main gear 16 with the double eccentric arrangement 8 and the connecting rod 7, exists, the switchable step-by-step motion gear coupling 21 can be closed again. In this way the forced coupling between the cyclical linear movement and the rotational stepping motion is recreated.

Not shown in FIG. 1 are a belt conveyor and a star loader assigned to the belt conveyor for the supply of hollow bodies in a tangential direction to a loading position of the workpiece turntable 3 and a further belt conveyor with a star unloader assigned to it for removal of hollow bodies in a tangential direction from an unloading position of the workpiece turntable 3 and further peripheral devices as known from the state of the art.

The invention claimed is:

1. A forming device for cup-shaped hollow bodies comprising:

a machine frame having a support plate, a support frame and supporting brackets, the support plate and the support frame forming a first machine frame section and the supporting brackets forming a second machine frame section;

a rotatable turntable for supporting one of a plurality of workpiece hollow bodies or a plurality of machining tools;

a linearly movable carrier for supporting the other of the plurality of workpiece hollow bodies or the plurality of machining tools, wherein the rotatable turntable and linearly movable carrier oppose one another, and wherein the rotatable turntable can be rotated in relation to the linearly movable carrier around an axis of rotation, and wherein the linearly movable carrier can be linearly displaced in relation to the rotatable carrier along the axis of rotation;

a drive mechanism supported by the supporting brackets of the second machine frame section for providing a rotational stepping motion and a cyclical linear motion between the rotatable turntable and the linearly movable carrier, in order to allow the forming of the hollow bodies by means of the machining tools in a plurality of sequential machining steps;

a stationary supporting tube disposed on the support plate of the first machine frame section, the stationary supporting tube having a central axis extending along the axis of rotation and supporting the linearly movable carrier;

a guiding device disposed on an external surface of the supporting tube for mounting the linearly movable carrier with the cyclical linear motion;

a rotary bearing disposed on the support plate of the first machine frame section for supporting the rotatable turntable, the rotary bearing being arranged with a spacing from the stationary supporting tube; and an articulated, flexible coupling area provided between the first machine frame section and the second machine frame section for substantially decoupling forces provided by the drive mechanism and the rotatable turntable and the linearly movable carrier.

2. A forming device according to claim 1, wherein an articulation axis of the articulated coupling area is aligned transversally to the axis of rotation.

3. A forming device according to claim 1, wherein, between the supporting tube and the tool carrier or the workpiece turntable, a pre-tensioned, rolling bearing arrangement is formed.

4. A forming device according to claim 3, wherein the rolling bearing arrangement is play-free.

5. A forming device according to claim 1, wherein the coupling area is in the form of a solid state joint.

6. A forming device for cup-shaped hollow bodies comprising:

a machine frame;

a rotatable turntable for supporting one of a plurality of workpiece hollow bodies or a plurality of machining tools;

a linearly movable carrier for supporting the other of the plurality of workpiece hollow bodies or the plurality of machining tools, wherein the rotatable turntable and linearly movable carrier oppose one another, and wherein the rotatable turntable can be rotated in relation to the linearly movable carrier around an axis of rotation, and wherein the linearly movable carrier can be linearly displaced in relation to the rotatable carrier along the axis of rotation;

a drive mechanism for providing a rotational stepping motion and a cyclical linear motion between the rotatable turntable and the linearly movable carrier, in order to allow the forming of the hollow bodies by means of the machining tools in a plurality of sequential machining steps;

a stationary supporting tube supported by the machine frame, the stationary supporting tube having a central axis extending along the axis of rotation and supporting the linearly movable carrier;

a guiding device disposed on an external surface of the supporting tube for mounting the linearly movable carrier with the cyclical linear motion, the guiding device comprising a pre-tensioned rolling bearing arrangement formed between the supporting tube and the linearly movable carrier;

a bearing device disposed on an internal surface of the supporting tube, the bearing device comprising a sliding bearing surface; and a coupling slide coupled to a connecting rod of the drive mechanism, the coupling slide being slidably supported on the sliding bearing surface of the bearing device for a force-transmitting joint between the connecting rod of the drive mechanism and the linearly movable carrier.

7. A forming device according to claim 6, wherein the supporting tube is arranged in a stationary manner on the machine frame.

8. A forming device according to claim 6, wherein the machine frame comprises a rotary bearing for the rotatable turntable arranged with a spacing from the supporting tube.

9. A forming device according to claim 8, wherein the rotary bearing and the supporting tube are arranged jointly on a support plate of the machine frame.

10. A forming device according to claim 9, wherein the support plate together with a support frame form a first machine frame section and wherein the drive mechanism is supported by supporting brackets, forming a second machine frame section, so that an at least extensive decoupling between the forces provided by the drive mechanism and the rotatable turntable and the linearly movable carrier is achieved.

11. A forming device according to claim 6, wherein, between the coupling slide and the linearly movable carrier, a circular design, flexible coupling means is arranged which is designed for the transfer of force between the coupling slide and the linearly movable carrier and for decoupling tilting motions of the coupling slide transversally to the axis of rotation.

12. A forming device according to claim 6, wherein a guide length for the linearly movable carrier along the supporting tube and/or for the coupling slide along the supporting tube is at least 1.5 times the maximum travel of the linearly movable carrier.

13. A forming device according to claim 6, wherein the supporting tube and the linearly movable carrier are arranged in a self-supporting manner on the machine frame.

* * * * *